US006929554B1

(12) United States Patent
Wheeler, Jr.

(10) Patent No.: US 6,929,554 B1
(45) Date of Patent: Aug. 16, 2005

(54) BILLIARDS INDICATOR SYSTEM AND METHOD

(76) Inventor: Durward Wheeler, Jr., 8201 Tapia Via Dr., Rancho Cucamonga, CA (US) 91730

( * ) Notice: Subject to any disclaimer, the term of this patent is extended or adjusted under 35 U.S.C. 154(b) by 0 days.

(21) Appl. No.: 10/388,897

(22) Filed: Mar. 14, 2003

(51) Int. Cl.[7] ..... A63D 15/00; A63D 15/08
(52) U.S. Cl. ..... 473/2; 473/44
(58) Field of Search ..... 473/1, 2, 35, 42, 473/44, 46; 40/19, 446, 493, 494; 229/4.5; 206/534, 459.1, 459.5, 433

(56) References Cited

U.S. PATENT DOCUMENTS

| | | | | |
|---|---|---|---|---|
| 1,159,133 A | | 11/1915 | Thomson | |
| 1,473,654 A | | 11/1923 | Sumner | |
| 1,487,629 A | * | 3/1924 | Wainwright, Jr. | 229/4.5 |
| 1,563,039 A | | 11/1925 | Newell | |
| 1,825,001 A | * | 9/1931 | Koch | 229/5.6 |
| 3,574,957 A | * | 4/1971 | Bello-Bridick | 434/173 |
| D238,428 S | * | 1/1976 | Schimanski | D23/369 |
| 3,965,590 A | * | 6/1976 | Algaze | 40/660 |
| 4,258,874 A | * | 3/1981 | Webinger et al. | 229/120 |
| 4,877,119 A | * | 10/1989 | Hosking | 206/459.1 |
| 5,433,324 A | * | 7/1995 | Leonard | 206/534 |
| 5,845,777 A | * | 12/1998 | Najmi | 206/459.1 |
| 6,699,136 B2 | * | 3/2004 | Kuo | 473/44 |

FOREIGN PATENT DOCUMENTS

| | | | | |
|---|---|---|---|---|
| GB | 2046600 A | * | 11/1980 | A63D 15/00 |
| GB | 2157576 A | * | 10/1985 | A63D 15/08 |

* cited by examiner

*Primary Examiner*—Mitra Aryanpour

(57) ABSTRACT

A billiards indicator system and method for providing a convenient reminder of whether a person is to shoot at solid colored or striped balls. The billiards indicator system and method includes a first conical member which is substantially hollow, and designed for being slideably received by an external surface of a lower portion of a pool cue. The first conical member has at least a pair of indicia positioned on a surface. Similarly, a second conical member is substantially hollow. The second conical member is rotatably coupleable with the first conical member. The first conical member is nested inside the second conical member. The second conical member has an aperture extending therethrough. The second conical member is rotatable to expose a selected one of the pair of indicia through the aperture.

8 Claims, 2 Drawing Sheets

BILLIARDS INDICATOR SYSTEM AND METHOD

BACKGROUND OF THE INVENTION

1. Field of the Invention

The present invention relates to indicator systems and more particularly pertains to a new billiards indicator system and method for providing a convenient reminder of whether a person is to shoot at solid colored or striped balls.

2. Description of the Prior Art

The use of indicator systems is known in the prior art. U.S. Pat. No. 1,473,654 describes a device for identifying umbrellas. Another type of indicator systems is U.S. Pat. No. 1,159,133 having a system for tracking games.

While these devices fulfill their respective, particular objectives and requirements, the need remains for a device that is easy to use, can be retrofit onto existing cues, and provides a minimum amount of interference for the user.

SUMMARY OF THE INVENTION

The present invention meets the needs presented above by using two nested conical member and a pair of indicia.

Another object of the present invention is to provide a new billiards indicator system and method that can be used in concert with one piece cues as well as multi-piece cues.

Even still another object of the present invention is to provide a new billiards indicator system and method that provides a clearly visible indicia.

To this end, the present invention generally comprises a first conical member which is substantially hollow, and designed for being slideably received by an external surface of a lower portion of a pool cue. The first conical member has at least a pair of indicia positioned on a surface. Similarly, a second conical member is substantially hollow. The second conical member is rotatably coupleable with the first conical member. The first conical member is nested inside the second conical member. The second conical member has an aperture extending therethrough. The second conical member is rotatable to expose a selected one of the pair of indicia through the aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
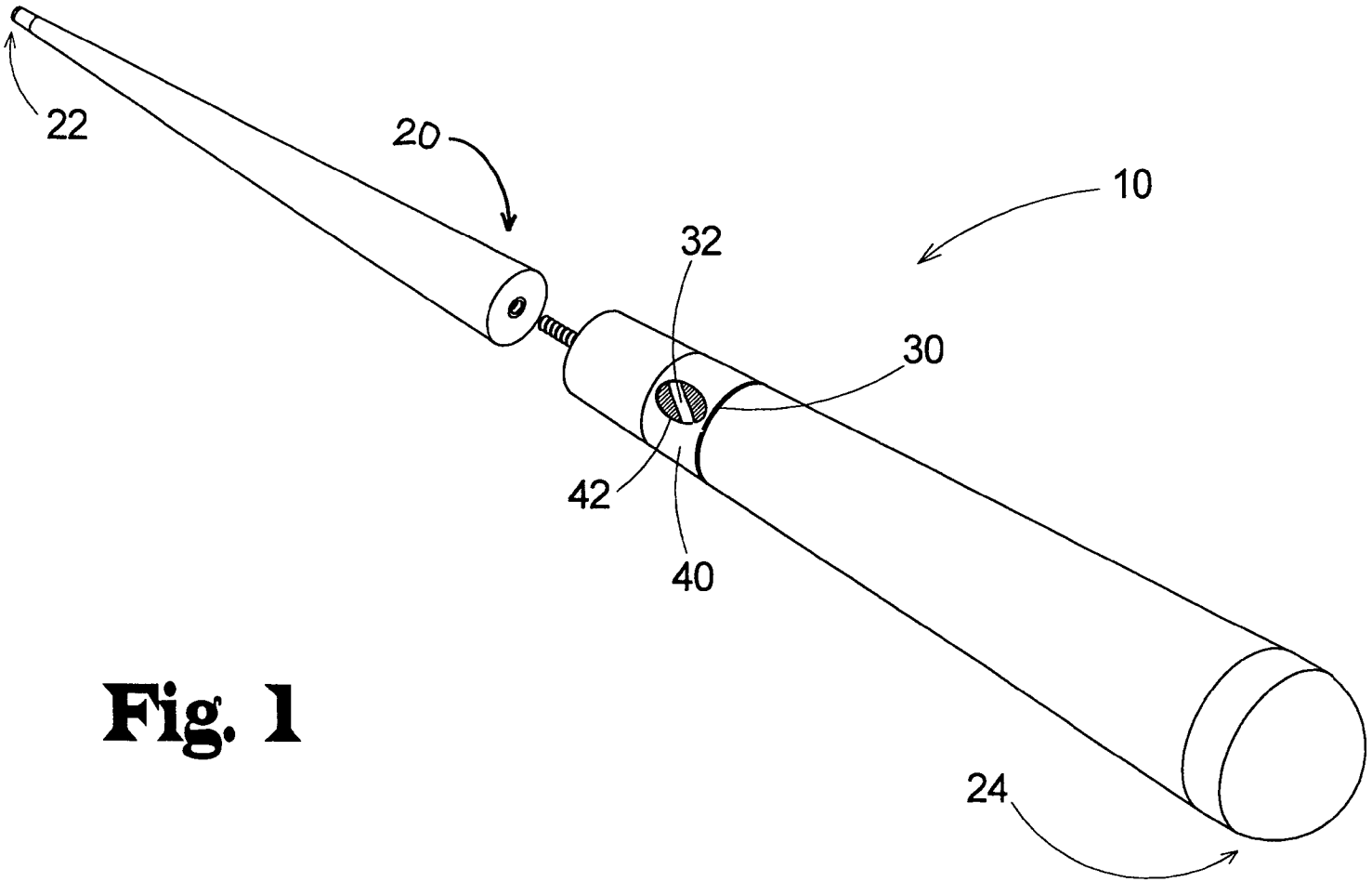
FIG. 1 is a schematic perspective view of a new billiards indicator system and method according to the present invention.
Figure 2:
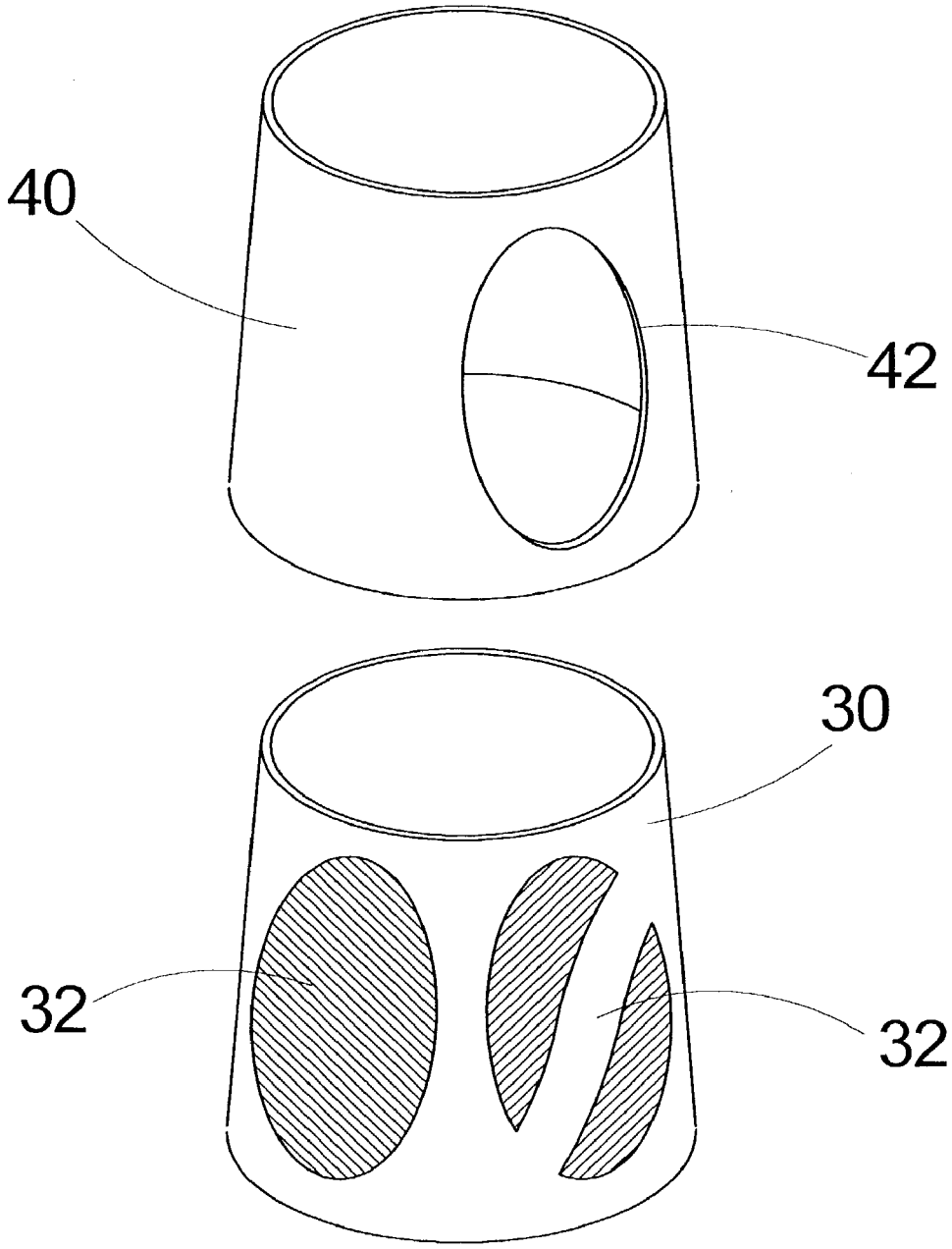
FIG. 2 is a schematic perspective front view of the present invention.

With reference now to the drawings, and in particular to FIGS. 1 and 2 thereof, a new billiards indicator system and method embodying the principles and concepts of the present invention and generally designated by the reference numeral 10 will be described.

As best illustrated in FIGS. 1 and 2, the billiards indicator system and method 10 generally comprises a pool cue 20, a first conical member 30, and a second conical member 40.

The pool cue 20 has a first end 22 and a second end 24. The pool cue 20 is cylindrical and tapered. Thus the first end 22 has a smaller diameter than the second end 24.

The first conical member 30 is substantially hollow. The first conical member 30 is designed for being slideably received by an external surface of a lower portion of the pool cue 20. The first conical member 30 has at least a pair of indicia 32 positioned on a surface.

The second conical member 40 is substantially hollow. The second conical member 40 is rotatably coupleable with the first conical member 30. The first conical member 30 is nested inside the second conical member 40. The second conical member 40 has an aperture 42 extending therethrough. The second conical member 40 is rotatable to expose a selected one of the pair of indicia 32 through the aperture 42.

In a preferred embodiment, the pair of indicia 32 further comprises a first indicia having a solid coloration and a second indicia having a stripped coloration.

In a further embodiment the nested first 30 and second conical members 40 have an overall height of approximately one inch a top diameter of approximately $7/8^{th}$ inch and a bottom diameter of approximately 1 inch.

Preferably the first and second conical members 30,40 are made of a polymeric material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A billiards indicator system for indicating whether the user is to shoot at solid or striped balls, comprising:

a pool cue having a first end and a second end, said pool cue being cylindrical, said pool cue being tapered whereby said first end having a smaller diameter than said second end;

a first conical member being substantially hollow, said first conical member adapted for being slideably received by an external surface of a lower portion of said pool cue, said first conical member having a pair of indicia positioned on a surface;

a second conical member being substantially hollow, said second conical member being rotatably coupleable with said first conical member, said first conical member being nested inside said second conical member, said second conical member having an aperture extending therethrough, said second conical member being rotatable to expose a selected one of said pair of indicia through said aperture.

2. The device of claim 1, wherein said pair of indicia further comprises a first indicia having a solid coloration and a second indicia having a stripped coloration.

3. The device of claim 1, wherein said device having an overall height of approximately one inch, said device having a top diameter of approximately $7/8^{th}$ inch and a bottom diameter of approximately 1 inch.

4. The device of claim 1, wherein said device comprises a polymeric material.

5. A method of indicating whether the user is to shoot at solid or striped balls, comprising:

providing a pool cue having a first end and a second end, said pool cue being cylindrical, said pool cue being tapered whereby said first end having a smaller diameter than said second end;

providing a first conical member being substantially hollow, said first conical member adapted for being slideably received by an external surface of a lower portion of said pool cue, said first conical member having a pair of indicia positioned on a surface;

providing a second conical member being substantially hollow, said second conical member being rotatably coupleable with said first conical member, said first conical member being nested inside said second conical member, said second conical member having an aperture extending therethrough, said second conical member being rotatable to expose a selected one of said pair of indicia through said aperture;

placing said first conical member over said first end of said pool cue;

sliding said first conical member downwardly along said pool cue until said first conical member solidly engages said pool cue;

placing said second conical member over said first end of said pool cue;

sliding said first conical member downwardly along said pool cue until said second conical member engages said first conical member;

rotating said second conical member with respect to said first conical member to expose a desired one of said pair of indicia.

6. The method of claim 5, wherein said pair of indicia further comprises a first indicia having a solid coloration and a second indicia having a stripped coloration.

7. The method of claim 5, wherein said device having an overall height of approximately one inch, said device having a top diameter of approximately $7/8^{th}$ inch and a bottom diameter of approximately 1 inch.

8. The method of claim 5, wherein said device comprises a polymeric material.

* * * * *